US007685823B2

(12) United States Patent
Martling et al.

(10) Patent No.: US 7,685,823 B2
(45) Date of Patent: Mar. 30, 2010

(54) AIRFLOW DISTRIBUTION TO A LOW EMISSIONS COMBUSTOR

(75) Inventors: Vincent C. Martling, Jupiter, FL (US); Zhenhua Xiao, Palm Beach Gardens, FL (US)

(73) Assignee: Power Systems Mfg., LLC, Jupiter, FL (US)

( * ) Notice: Subject to any disclaimer, the term of this patent is extended or adjusted under 35 U.S.C. 154(b) by 1014 days.

(21) Appl. No.: 11/262,447

(22) Filed: Oct. 28, 2005

(65) Prior Publication Data

US 2009/0139238 A1 Jun. 4, 2009

(51) Int. Cl.
*F02C 1/00* (2006.01)

(52) U.S. Cl. ..... 60/760; 60/754

(58) Field of Classification Search ..... 60/772, 60/752–760

See application file for complete search history.

(56) References Cited

U.S. PATENT DOCUMENTS 3,936,215 A 2/1976 Hoff
4,005,574 A 2/1977 Smith, Jr.
4,090,360 A * 5/1978 Erismann ..... 60/794
4,362,500 A * 12/1982 Eriksson et al. ..... 431/352
4,458,481 A 7/1984 Ernst
5,076,053 A 12/1991 McVey et al.
5,363,653 A * 11/1994 Zimmermann et al. ..... 60/751
5,397,215 A 3/1995 Spear et al.
6,234,747 B1 * 5/2001 Mielke et al. ..... 415/119

* cited by examiner

*Primary Examiner*—Michael Cuff
*Assistant Examiner*—Andrew Nguyen

(57) ABSTRACT

An apparatus and method of providing a gas turbine combustor having increased combustion stability and reducing pressure drop across a gas turbine combustor is disclosed. A plurality of vanes is fixed to a flow sleeve radially between the flow sleeve and a combustion liner. The plurality of vanes serve to direct a flow of air entering the region between the flow sleeve and combustion liner in a substantially axial direction, such that components of tangential velocity are removed thereby providing a more uniform flow of air the combustion chamber and reducing the amount of pressure lost due attempting to straighten the airflow by pressure drop alone.

19 Claims, 4 Drawing Sheets

AIRFLOW DISTRIBUTION TO A LOW EMISSIONS COMBUSTOR

TECHNICAL FIELD

The present invention applies generally to gas turbine combustors and more specifically to an apparatus and method for providing improved combustion stability and lower pressure drop across the combustion system.

BACKGROUND OF THE INVENTION

In a combustion system for a gas turbine, fuel and compressed air are mixed together and ignited to produce hot combustion gases that drive a turbine and produce thrust or drive a shaft coupled to a generator for producing electricity. In an effort to reduce pollution levels, government agencies have introduced new regulations requiring gas turbine engines to reduce emitted levels of emissions, including carbon monoxide (CO) and oxides of nitrogen (NOx). A common type of combustion, employed to comply with these new emissions requirements, is premix combustion, where fuel and compressed air are mixed together prior to ignition to form as homogeneous a mixture as possible and burning this mixture to produce lower emissions. While premixing fuel and compressed air prior to combustion has its advantages in terms of emissions, it also has certain disadvantages such as combustion instabilities and more specifically combustion dynamics.

In order to achieve the lowest possible emissions through premixed combustion, without the use of a catalyst, it is necessary to provide a fuel-lean mixture to the combustor. Generally, in combustors using fuel-lean mixtures, as the fuel-air mixture becomes more fuel rich (i.e. higher fuel-air ratio), the flame and combustion process becomes more stable. (Of course, if the fuel-air mixture becomes too fuel rich, the flame and combustion process becomes more unstable, and can lead to rich fuel blowout.) Therefore, fuel-lean mixtures tend to be more unstable given the lesser fuel content for a given amount of air. As a result, when fuel-lean mixtures are burned they tend to produce greater pressure fluctuations due to the unstable flame. A factor contributing to the unstable flame is the fuel-air ratio or more specifically, the amount of air mixing with a known amount of fuel. The amount of air entering into a combustion chamber can vary depending on how the air is directed towards the combustion chamber inlet. If the airflow is not uniform and not relatively free from swirl, the amount of air entering the combustor will fluctuate, thereby altering the fuel-air ratio, and adversely affecting combustion stability and NOx emissions.

An example of a gas turbine combustor of the prior art that employs premix combustion is shown in cross section in FIG. 1. A gas turbine combustor 10 comprises fuel injection system 11, combustion liner 12, transition duct 13, first outer sleeve 14, and second outer sleeve 15. For the combustor shown in FIG. 1, air used for combustion, represented by arrows, enters into generally annular passage 16 through a plurality of holes in first outer sleeve 14 and second outer sleeve 15. In this prior art system, the air enters at different axial locations and at different angles, including generally perpendicular to the walls of combustion liner 12 and transition duct 13. As a result, the air flow in generally annular passage 16 has some swirl, or tangential velocity component. It is this swirl that causes a non-uniform air flow distribution to combustion liner 12, and hence creates combustion stability problems by causing the fuel-air ratio in the combustor to fluctuate. In order to try and non-mechanically reduce the swirl effects, a greater pressure drop was taken across generally annular passage 16 through the sizing of passage 16 and sizing of plurality of holes in first outer sleeve 14 and second outer sleeve 15. The additional pressure drop taken across the combustor of the prior art results in overall loss in the efficiency of the gas turbine. As those skilled in the art will readily appreciate, higher pressure drop across the combustion system results in lower gas turbine cycle efficiency, so designers of gas turbine combustion systems seek to minimize this pressure drop.

Therefore, it is desired to provide a combustion system for a gas turbine wherein the geometry of the combustor provides a means for significantly reducing the tangential velocity, or swirl, for air directed to a combustion inlet so as to reduce combustion stability problems and NOx, and to reduce the overall pressure drop required across the combustor. Reducing the combustor pressure drop, will in turn improve the gas turbine efficiency, increase power output, and lower fuel operating cost.

SUMMARY AND OBJECTS OF THE INVENTION

An apparatus and method of providing a gas turbine combustor having increased combustion stability, lower NOx, reduced pressure drop across a gas turbine combustor, and higher efficiency is provided. A gas turbine combustor comprising a flow sleeve, combustion liner, at least one fuel nozzle, and a plurality of vanes fixed to the flow sleeve radially between the flow sleeve and combustion liner is disclosed. The plurality of vanes serve to mechanically direct a flow of air entering the region between the flow sleeve and combustion liner in a substantially axial direction, such that components of tangential velocity are removed thereby providing a more uniform flow of air to the combustion chamber and reducing the amount of pressure lost due attempting to straighten the airflow by pressure drop alone.

It is an object of the present invention to provide a gas turbine combustor having a reduced pressure drop across the combustor thereby improving the thermal efficiency of the gas turbine.

It is another object of the present invention to provide a gas turbine combustor having improved combustion stability and reduced dynamics by providing a more uniform air flow to the combustion chamber.

It is another object of the present invention to provide a gas turbine combustor having reduced NOx as compared to the gas turbine combustors of the prior art.

In accordance with these and other objects, which will become apparent hereinafter, the instant invention will now be described with particular reference to the accompanying drawings.

DETAILED DESCRIPTION OF THE PREFERRED EMBODIMENT

Figure 1:
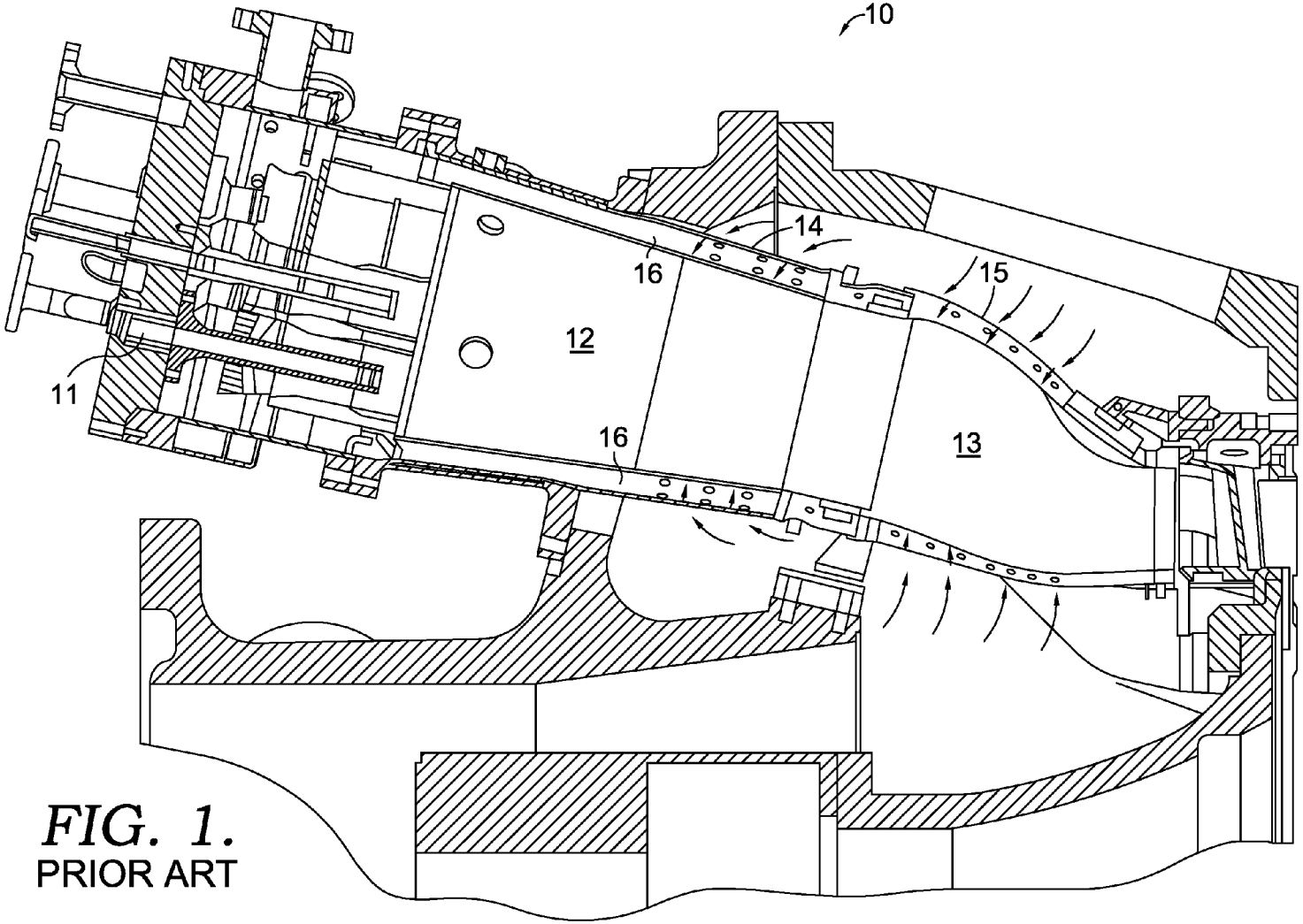
FIG. 1. PRIOR ART
FIG. 1 is a cross section view of a gas turbine combustor in accordance with the prior art.
Figure 2:
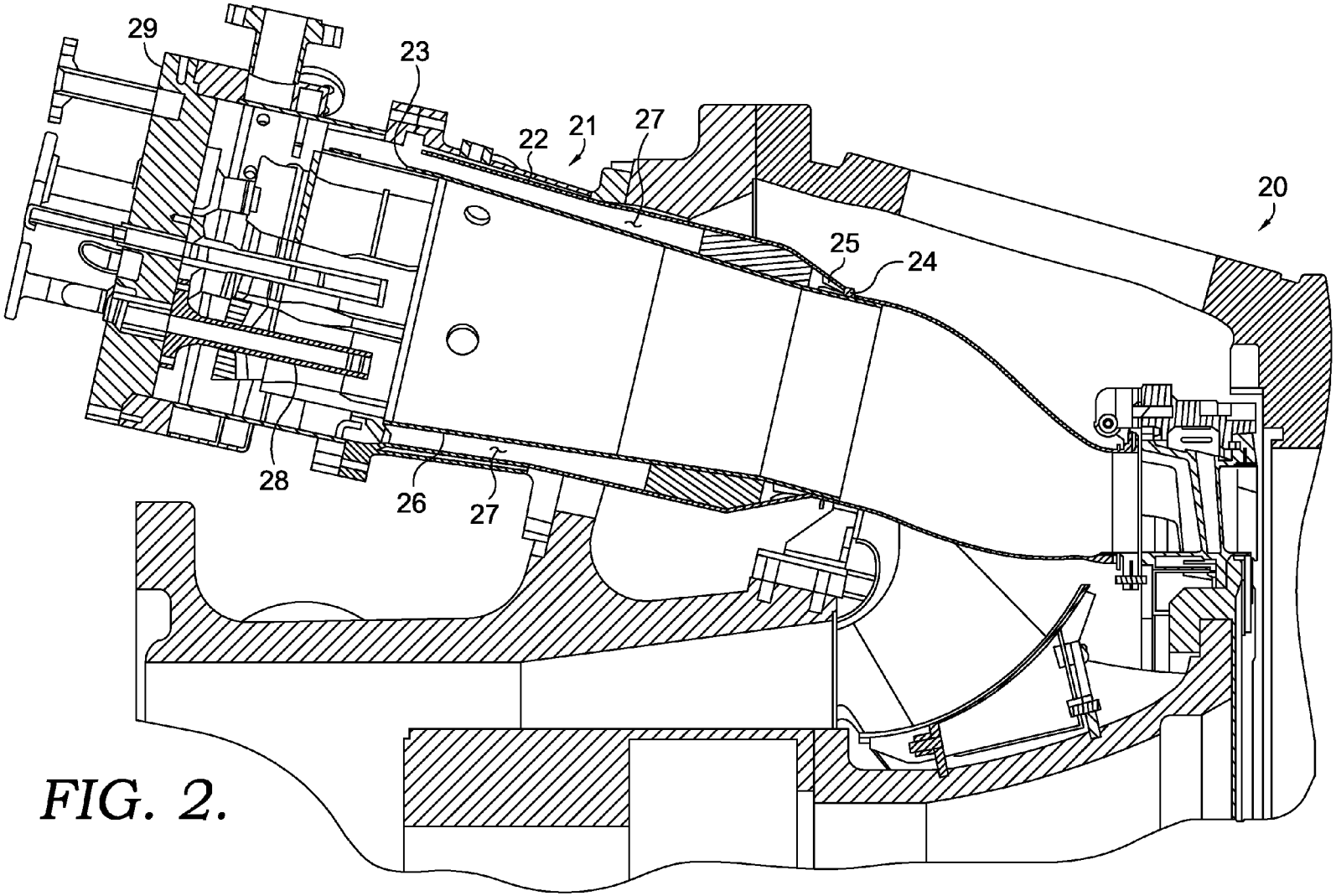
FIG. 2 is a cross section view of a gas turbine combustor in accordance with the preferred embodiment of the present invention.
Figure 3:
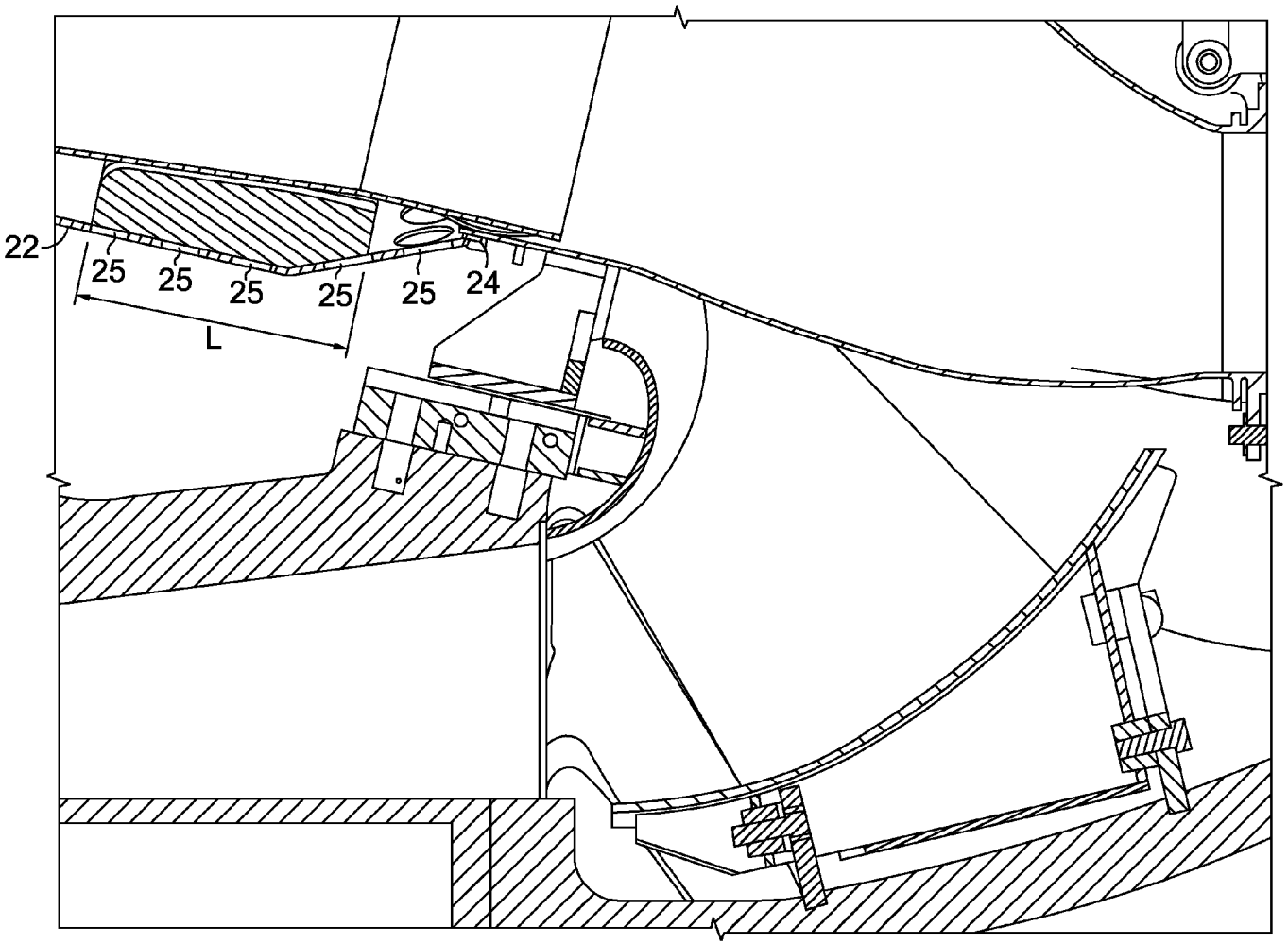
FIG. 3 is a detailed cross section view of a portion of a gas turbine combustor in accordance with the preferred embodiment of the present invention.
Figure 4:
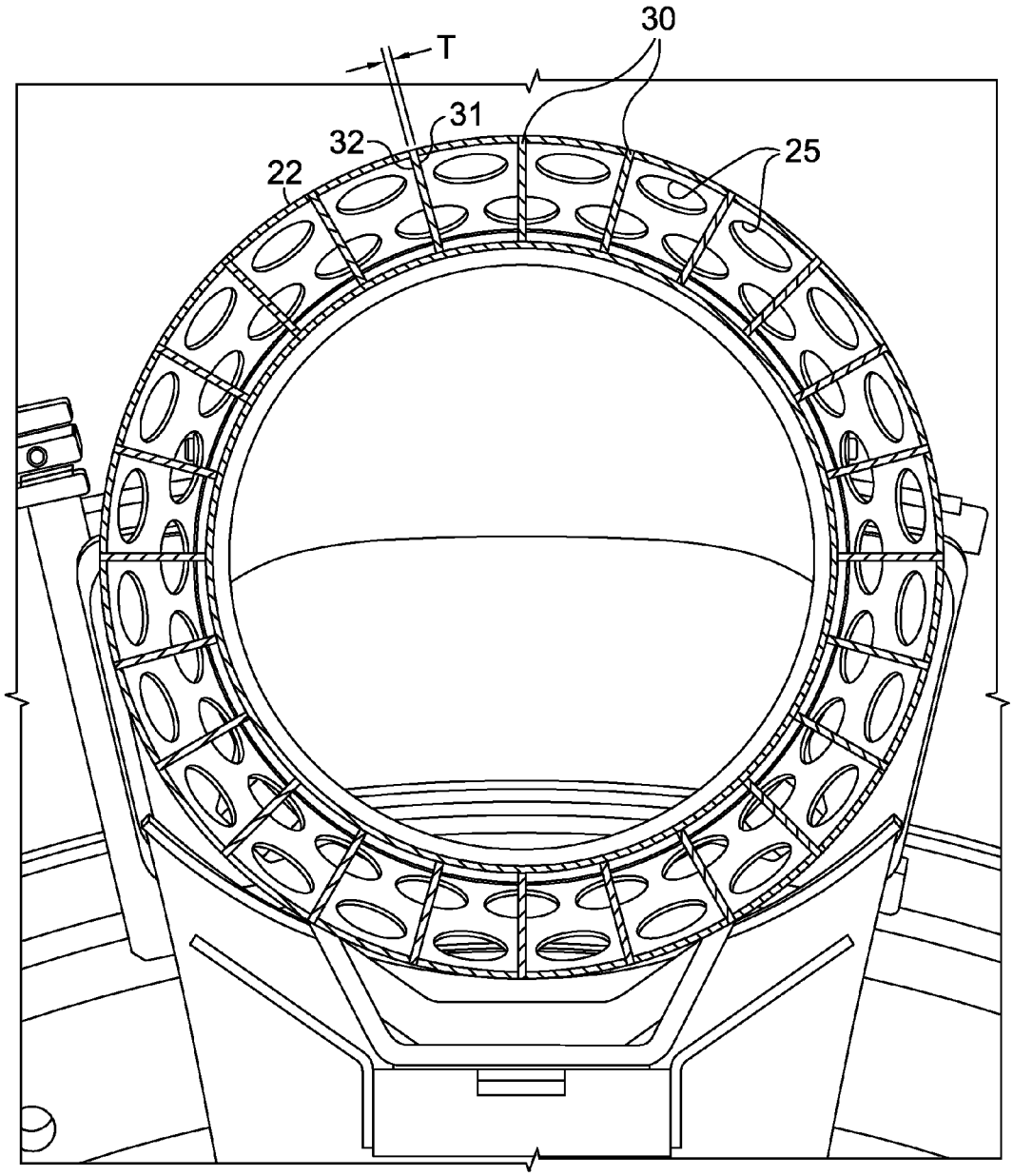
FIG. 4 is an end view taken in cross section of a portion of a gas turbine combustor in accordance with the preferred embodiment of the present invention.

The preferred embodiment of the present invention will now be described in detail with particular reference to FIGS. 2-4. Referring to FIG. 2, a portion of gas turbine engine 20 is shown in cross section. In the preferred embodiment, a plurality of gas turbine combustors 21 are mounted to gas turbine engine 20, one of which is shown in FIG. 2. Combustor 21 comprises flow sleeve 22 having first end 23, second end 24, and a plurality of first holes 25 located proximate second end 24. In accordance with the preferred embodiment, plurality of first holes 25 is spaced axially in circumferential rows about flow sleeve 22 as shown in FIG. 4 and plurality of first holes 25 each preferably have a diameter of up to 2.50 inches. Located radially within flow sleeve 22 is combustion liner 26, thereby forming first passage 27 between combustion liner 26 and flow sleeve 22. Positioned at the forward end of combustion liner 26 for injecting a fuel to mix with air in combustion liner 26 is at least one fuel nozzle 28. For the preferred embodiment of the present invention a plurality of fuel nozzles 28 are utilized and are each fixed to an end cover 29 which supplies fuel to each fuel nozzle 28.

An additional feature of flow sleeve 22 is plurality of vanes 30 that are fixed to flow sleeve 22 proximate plurality of first holes 25. Plurality of vanes 30 extend radially inward towards combustion liner 26 into first passage 27. The quantity of plurality of vanes 30 preferably corresponds equally to the quantity of plurality of first holes 25 as shown in FIG. 4. Furthermore, plurality of vanes 30 is oriented generally axially along flow sleeve 22 such that they each significantly remove the tangential velocity component, or swirl, from the air entering first passage 27 through plurality of first holes 25. The plurality of vanes 30 thereby serve to direct the air in a substantially axial direction towards flow sleeve first end 23. This is best depicted pictorially in FIG. 4 where plurality of vanes 30 is preferably equally spaced circumferentially about flow sleeve 22. Furthermore, each vane 30 has an axial length L as shown in FIG. 3 and first wall 31 and second wall 32 as shown in FIG. 4, thereby forming vane thickness T, with first wall 31 and second wall 32 terminating in an edge opposite flow sleeve 32. Plurality of vanes 30 are sized to reduce the swirl in airflow entering first passage 27. Therefore, axial length L and thickness T will vary depending on individual combustor design and airflow characteristics. In order to prevent additional pressure losses in first passage 27, it is preferred that the vane edge is rounded. Furthermore, it is important to note that in order to minimize swirl of the air flow, it is desirable for plurality of vanes to extend towards combustion liner 26, but terminate a distance such that the vane edge does not contact combustion liner 26 under any conditions. Incidental contact between plurality of vanes 30 and combustion liner 26 can cause wear and stress to both plurality of vanes 30 and combustion liner 26. For the preferred embodiment, the radial distance between the vane edge and combustion liner 26 is up to 1.0 inch to ensure a minimal gap is maintained under all operating conditions.

In addition to the apparatus described above, a method for reducing the pressure drop across a gas turbine combustor is disclosed that incorporates the combustion apparatus of the present invention. A method for reducing pressure drop across a combustor comprises the steps of providing a gas turbine combustor 21 comprising a flow sleeve 22 having a first end 23, a second end 24, and a plurality of first holes 25 located proximate second end 24. Combustor 21 also comprises combustion liner 26 located radially within flow sleeve 22, thereby forming first passage 27 therebetween, and at least one fuel nozzle 28 for injecting a fuel to mix with air in the combustion liner. Furthermore, combustor 21 comprises a plurality of vanes 30 fixed to flow sleeve 22 proximate plurality of first holes 25 and extending radially inward into first passage 27 towards combustion liner 26. Next, a flow of compressed air is directed through plurality of first holes 25, into first passage 27, and between plurality of vanes 30. The airflow is then straightened by the plurality of vanes 30 to significantly remove the tangential velocity component from the flow of compressed air and then directed in a substantially axial direction towards flow sleeve first end 23 in a more uniform pattern. As a result of the plurality of first holes 25 and plurality of vanes 30 mechanically straightening the passing airflow, pressure drop across combustor 21 from flow sleeve second end 24 to flow sleeve first end 23 is reduced. A lower pressure drop across flow sleeve 22 and first passage 27 results in more power output, higher thermal efficiency, and reduced fuel operating costs for the gas turbine in which the combustor of the present invention is used.

While the invention has been described in what is known as presently the preferred embodiment, it is to be understood that the invention is not to be limited to the disclosed embodiment but, on the contrary, is intended to cover various modifications and equivalent arrangements within the scope of the following claims.

We claim:

1. A gas turbine combustor having increased combustion stability, said combustor comprising:

A flow sleeve having a first end, a second end, and a plurality of first holes in a plurality of axially spaced rows located proximate said second end;

A combustion liner located radially within said flow sleeve thereby forming a first passage therebetween;

At least one fuel nozzle for injecting a fuel to mix with air in said combustion liner; and, A plurality of vanes, said vanes fixed to said flow sleeve proximate said plurality of first holes and extending radially inward towards said combustion liner into said first passage such that said plurality of vanes significantly remove the tangential velocity component from air entering said first passage through said plurality of first holes, thereby directing said air in a substantially axial direction towards said flow sleeve first end, wherein said plurality of vanes are equal in number to a quantity of first holes in a row and wherein said vanes are circumferentially offset from said holes in at least one of said axially spaced rows while bisecting remaining holes in said flow sleeve.

2. The gas turbine combustor of claim 1 wherein said plurality of vanes are equally spaced circumferentially about said flow sleeve.

3. The gas turbine combustor of claim 1 wherein said vanes have an axial length, a first wall and a second wall, thereby establishing a vane thickness, said first wall and second wall terminating in an edge opposite said flow sleeve.

4. The gas turbine combustor of claim 3 wherein said vane edge is rounded.

5. The gas turbine combustor of claim 3 wherein said vane edge is spaced a radial distance from said combustion liner.

6. The gas turbine combustor of claim 5 wherein said radial distance is up to 0.350 inches.

7. The gas turbine combustor of claim 1 wherein said plurality of first holes are spaced axially in circumferential rows about said flow sleeve.

8. The gas turbine combustor of claim 7 wherein said plurality of first holes have a diameter of up to 2.00 inches.

9. The method for reducing pressure drop across a gas turbine combustor, said method comprising the steps:

Providing a gas turbine combustor comprising a flow sleeve having a first end, a second end, and a plurality of first holes in a plurality of axially spaced rows located proximate said second end, a combustion liner located radially within said flow sleeve thereby forming a first passage therebetween, at least one fuel nozzle for injecting a fuel to mix with air in said combustion liner, and a plurality of vanes, said vanes fixed to said flow sleeve proximate said plurality of first holes and extending radially inward towards said combustion liner into said first passage, wherein said plurality of vanes are equal in number to a quantity of first holes in a row and wherein said vanes are circumferential offset from said holes in at least one of said axially spaced rows while bisecting remaining holes in said flow sleeve;

Directing a flow of compressed air through said plurality of first holes, into said first passage, and between said plurality of vanes;

Straightening said flow of compressed air by way of said plurality of vanes to significantly remove the tangential velocity component from said flow of compressed air and then directing said flow of compressed air in a substantially axial direction towards said flow sleeve first end, wherein pressure drop across said combustor from said flow sleeve second end to said flow sleeve first end is reduced by mechanically straightening said flow of compressed air through said plurality of vanes.

10. The method of claim 9 wherein said plurality of vanes are equally spaced circumferentially about said flow sleeve.

11. The method of claim 9 wherein said vanes have an axial length, a first wall and a second wall, thereby establishing a vane thickness, said first wall and second wall terminating in an edge opposite said flow sleeve.

12. The method of claim 11 wherein said vane edge is rounded.

13. The method of claim 11 wherein said vane edge is spaced a radial distance from said combustion liner.

14. The method of claim 13 wherein said radial distance is up to 0.350 inches.

15. A gas turbine combustor having a more uniform circumferential air flow distribution, said combustor comprising:

A flow sleeve having a first end, a second end, and a plurality of first holes in a plurality of axially spaced rows located proximate said second end;

A combustion liner located radially within said flow sleeve thereby forming a first passage therebetween;

At least one fuel nozzle for injecting a fuel to mix with air in said combustion liner; and A plurality of vanes fixed to said flow sleeve proximate said plurality of first holes and extending radially inward into said first passage towards said combustion liner, wherein said plurality of vanes are equal in number to a quantity of first holes in a row and wherein said vanes are circumferentially offset from said holes in at least one of said axially spaced rows while bisecting remaining holes in said flow sleeve so as to provide substantially uniform air flow to areas between each of said vanes.

16. The gas turbine of claim 15 wherein said plurality of vanes are equally spaced circumferentially about said flow sleeve.

17. The gas turbine combustor of claim 16 wherein said vanes have an axial length, a first wall and a second wall, thereby establishing a van thickness, said first wall and second wall terminating in an edge opposite said flow sleeve.

18. The gas turbine combustor of claim 17 wherein said vane edge is rounded.

19. The gas turbine combustor of claim 15 wherein said radial distance is up to 0.350 inches.

* * * * *